US006283010B1

(12) United States Patent
Fritz et al.

(10) Patent No.: US 6,283,010 B1
(45) Date of Patent: Sep. 4, 2001

(54) PISTON ROD-LESS PNEUMATIC CYLINDER

(75) Inventors: Erhard Fritz, Königsbach/Stein; Peter Rohatschek, Metzingen, both of (DE)

(73) Assignee: Hygrama AG, Rotkreuz (CH)

( * ) Notice: Subject to any disclaimer, the term of this patent is extended or adjusted under 35 U.S.C. 154(b) by 0 days.

(21) Appl. No.: 09/343,047

(22) Filed: Jun. 29, 1999

(30) Foreign Application Priority Data

Jul. 1, 1998 (AT) ..... 441/98 U

(51) Int. Cl.[7] ..... F01B 29/00
(52) U.S. Cl. ..... 92/88; 277/345
(58) Field of Search ..... 92/88; 277/345

(56) References Cited

U.S. PATENT DOCUMENTS

Re. 33,637 * 7/1991 Hoglund ..... 92/88
4,733,604 * 3/1988 Lipinski ..... 92/88
4,991,494 * 2/1991 Migliori ..... 92/88
5,467,686 * 11/1995 Lipinski ..... 92/88
5,517,901 * 5/1996 Lipinski ..... 92/88

FOREIGN PATENT DOCUMENTS

3124878 C1 * 12/1982 (DE) ..... 92/88
0068088 * 1/1983 (EP) ..... 92/88

* cited by examiner

*Primary Examiner*—John E. Ryznic
(74) *Attorney, Agent, or Firm*—Dykema Gossett PLLC

(57) ABSTRACT

In a piston rod-less pneumatic cylinder, the sealing tape (5) sealing the lateral longitudinal slot (3) from the inside on either side of the piston (2) is held by an outer band (6) covering the longitudinal slot (3) from outside with the cylinder interior (9, 10) in an unpressurized state. To reduce the forces necessary to engage or disengage this fixing joint, fixing elements (16, 17) interact in a purely frictionally engaged manner on the sealing tape (5) and outer band (6).

5 Claims, 1 Drawing Sheet

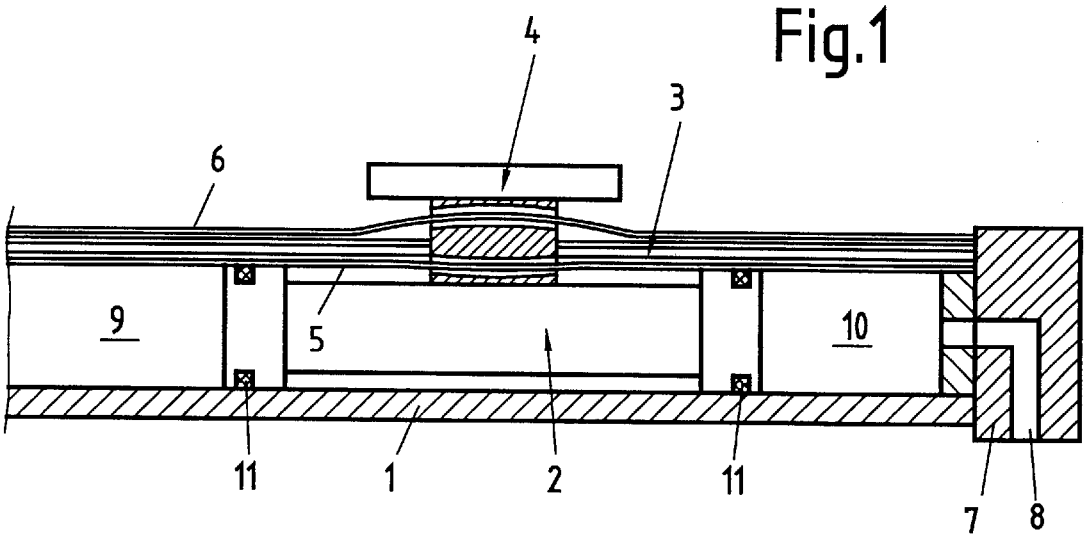
Fig.1
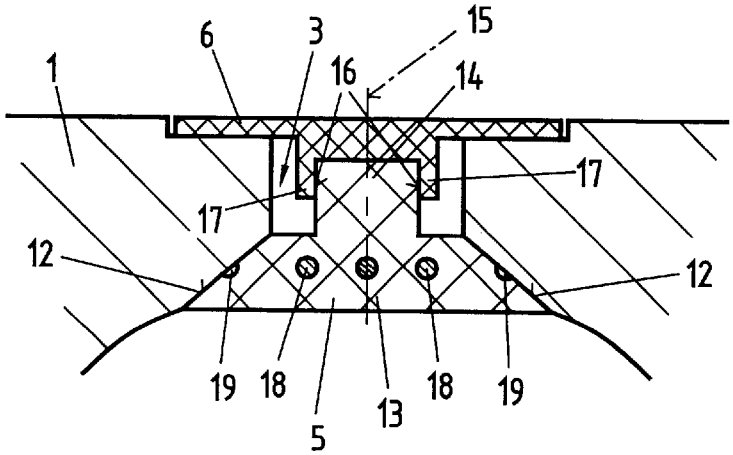
Fig.2
Fig.3
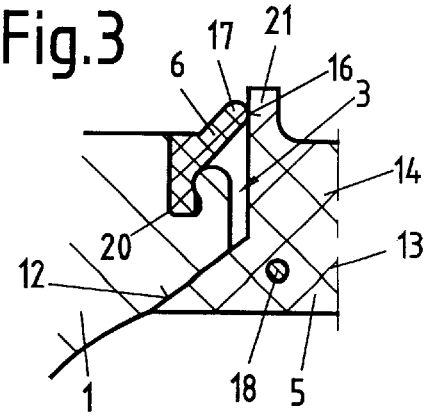
Fig.4
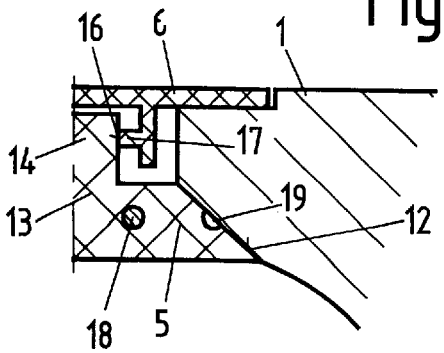

PISTON ROD-LESS PNEUMATIC CYLINDER

BACKGROUND OF THE INVENTION

1. Field of the Invention

The invention relates to a piston rod-less pneumatic cylinder, with a piston longitudinally movable inside a cylinder tube and a transmission element that engages with this piston and projects out through a longitudinal slot in the cylinder tube, along with a sealing tape that seals the longitudinal slot from the inside on either side of the piston, which is routed through the piston in the area of the transmission element, and exhibits a sealing strip that interacts with two longitudinally extending sealing areas near the end of the longitudinal slot inside the cylinder, along with at least one fixing strip arranged on the outside of the sealing strip with two fixing elements that lie opposite one another relative to the center plane of the longitudinal slot, and are essentially longitudinally extended and directed toward the outside, and with an outer band that at least partially covers the longitudinal slot from outside on either side of the piston, wherein this outer band exhibits fixing elements that engage the fixing elements of the sealing tape to secure the sealing tape in the longitudinal slot, with the sealing tape being spaced apart from the walls of the longitudinal slot except for the sealing areas.

2. The Prior Art

Piston rod-less pneumatic cylinders vary widely in design, and are most often used as pneumatically actuated working cylinders in arrangements where the smaller fitting length is advantageous relative to cylinders with piston rods. The force exerted on the piston by the pressure medium is conveyed from the transmission element that projects out through the lateral longitudinal slot to the device to be operated. The delivery chambers lying on either side of the piston are sealed off by packing rings or sealing cuffs on the piston, and also by the sealing tape abutting from the inside on the longitudinally extended sealing areas near the end of the longitudinal slot, wherein the sealing tape is routed through in the inside under the transmission element of the piston in the unpressurized area between the piston seals.

The sealing tape is pressed against the longitudinally extended sealing areas by the pressure prevailing in the respectively pressurized cylinder interior. However, precautions must normally be introduced to prevent the sealing tape from sagging into the interior when the latter is in an unpressurized state, since this would result in at least a temporary leak as pressure begins to build in this previously unpressurized interior.

In the above connection, for example, EP 69 199 B1 discloses a pneumatic cylinder of the kind mentioned at the outset in which an outer band that covers the longitudinal slot from outside to prevent foreign objects, contaminants and the like from penetrating is provided simultaneously to hold the inner sealing tape. To this end, the fixing strip located centrally in the sealing strip or sealing tape exhibits projections on both sides as longitudinally extended fixing elements that are overlapped by two accompanying ledge-shaped fixing elements of the outer band. As a result, the sealing tape is held with an overall positive fit to the outer band, and hence in the longitudinal slot, even if no pressure is acting on the sealing tape from the inside. Since the longitudinal slot itself can remain free of fixing grooves and the like, the cylinder tube is relatively simple in design, wherein the transmission element can also be laterally guided or supported in the longitudinal slot.

The only disadvantage to the discussed known design is the fact that engaging and disengaging the sealing tape mount on the outer band does require relatively high forces due to the joint with a positive fit, which must be taken into account in the structure and design of the interacting bands, in particular to prevent the outer band from becoming drawn into the longitudinal slot or lifting off of the longitudinal slot due to the inner sealing tape. The object of this invention is to avoid the mentioned disadvantages, in particular to improve a pneumatic cylinder of the kind mentioned at the outset in such a way as to simplify the securing of the sealing tape during the safe operation of the arrangement.

SUMMARY OF THE INVENTION

The object is achieved according to the invention for a pneumatic cylinder of the kind mentioned at the outset by having the fixing elements on the sealing tape and outer band interact in a purely frictionally engaged manner. Surprisingly, it was discovered that the lower retention forces to be applied are entirely sufficient to hold the inner sealing tape reliably in the slot or have it form a seal on the longitudinally extended sealing areas near the end of the longitudinal slot on the cylinder interior, even with the cylinder space lying below in an unpressurized state. As a result, the described leaks can be avoided without the mentioned problems relating to the outer band coming about due to excessively high forces to be overcome while joining or separating this connection.

In a preferred embodiment of the invention, the outer band is designed as a single unit, and exhibits essentially striated fixing elements to hold the sealing tape on its side facing the interior of the cylinder tube. This simple design is similar in some way to the one de scribed above relating to prior art, except that retention is purely frictional here, and does not involve a positive fit.

In another preferred embodiment of the invention, however, the outer band can be divided in a longitudinal direction, and the fixing strip of the sealing tape can be securely held in between the two parts. As a result, the divided outer band and the inner sealing tape secured in between together take over the function of covering the longitudinal slot on the outside. The divided outer band held in a groove, e.g., through clamping, is safeguarded even more against being drawn into the longitudinal slot in this variant.

In another preferred embodiment of the invention, the sealing tape along with, advantageously, the outer band can consist of a flexible material, preferably plastic, e.g., polyurethane, with at least the sealing strip of the sealing tape exhibiting inserted or simultaneously formed linear reinforcements extending in the longitudinal direction, preferably made out of steel wire or kevlar fibers. This makes it possible to manufacture the tape and band in accordance with practical requirements.

BRIEF DESCRIPTION OF THE DRAWINGS

In the following, the invention will be explained in greater detail based on the practical examples in part schematically shown in the drawing.

FIG. 1 shows a longitudinal section through a pneumatic cylinder according to the invention, and FIGS. 2 to 4 show various detailed cross sections of preferred embodiments of the inventive pneumatic cylinder in the area of the longitudinal slot.

DETAILED DESCRIPTION OF THE PREFERRED EMBODIMENTS

The piston rod-less pneumatic cylinder according to FIG. 1 exhibits a piston 2 longitudinally moveable inside a cylinder tube 1, and a transmission element 4 that engages with this piston and projects out through a longitudinal slot 3 in cylinder tube 1. Also provided is a sealing tape 5 that seals longitudinal slot 3 from the inside on either side of piston 2, which in the area of transmission element 4 is routed through the latter or piston 2. Longitudinal slot 3 is covered on the outside by an outer band 6, which in the area of transmission element 4 is also routed through the latter. Sealing tape 5 and outer band 6 are secured in the area of lids 7 that tightly seal cylinder tube 1 on either side, wherein these lids 7 also exhibit feed lines 8 for the pressure medium.

The force exerted on the piston 2 by the pressure medium is conveyed from the transmission element 4 that engages with the piston 2 and projects out through the lateral longitudinal slot 3 to a device to be operated (not shown). Delivery chambers 9, 10 lying on either side of piston 2 are sealed off by packing rings 11 on piston 2 on the one hand, and by sealing tape 5 covering longitudinal slot 3 from the inside on the other hand, which is routed toward the inside under transmission element 4 or through piston 2 in the unpressurized area between packing rings 11.

In FIG. 2, the sealing tape 5 exhibits a sealing strip 13 that interacts with two longitudinally extended sealing areas 12 near the end of longitudinal slot 3 inside the cylinder, along with a fixing strip 14 arranged on the outside of sealing strip 13 with two fixing elements (or fixing areas) 16 that lie opposite one another relative to center plane 15 of longitudinal slot 3, and are essentially longitudinally extended and directed toward the outside. Visible on the outside of longitudinal slot 3 is outer band 6 that at least partially covers longitudinal slot 3 from outside on either side of piston 2, wherein this outer band exhibits additional fixing elements 17 that engage fixing elements (or fixing areas) 16 of sealing tape 5 to secure sealing tape 5 in longitudinal slot 3, with sealing tape 5 being spaced apart from the walls of longitudinal slot 3 except for sealing areas 12.

As evident from their design as shown in FIG. 2, fixing elements 16 and 17 on sealing tape 5 and outer band 6 interact in a purely frictionally engaged manner, so that this connection can be easily opened or joined in the unpressurized area between sealing rings 11 of piston 2. In the respectively pressurized delivery chambers 9 and 10, the inner sealing tape 5 is pressed into longitudinal slot 3 or against sealing areas 12 anyway by the internal pressure; in the respectively unpressurized delivery chambers 9 and 10, the retention force applied by the interacting fixing elements 16 and 17 is sufficient.

In FIG. 2, outer band 6 is designed as a single unit, and exhibits essentially striated fixing elements 17 to hold the sealing tape 5 on its side facing the interior of the cylinder tube 11, wherein the dimensioning is such that the fixing strip 14 is easily clamped in a flexible manner between fixing elements 17 by its fixing elements 16. Sealing tape 5 and also outer band 6 consist of a flexible material, preferably plastic, e.g., polyurethane, wherein at least sealing strip 13 of sealing tape 5 exhibits inserted or simultaneously formed linear reinforcements 18 extending in the longitudinal direction, for example, made of steel wire or para-aramid fibers sold by E. I. DuPont under the trademark KEVLAR. Longitudinal grooves 19 are also provided on sealing strip 13 near sealing areas 12, which enable or facilitate a separate processing of areas of sealing strip 13 facing the inside of cylinder tube 1 to improve the seal.

In the embodiment according to FIG. 3, outer band 6 is divided into groove-shaped recesses 20 in a longitudinal direction and held next to longitudinal slot 3, wherein fixing strip 14 of sealing tape 5 is held at longitudinally extended shoulders 21, secured between the two parts of outer band 6. Therefore, fixing elements (or fixing areas) 16, 17 interact in a purely frictional manner at sealing tape 5 or outer band 6 here as well.

The embodiment according to FIG. 4 is similar to that in FIG. 2, but one-piece outer band 6 stands apart relative to the inner sealing tape, except for interacting fixing elements 16, 17. Otherwise, please refer to the above statements about FIG. 2 with respect to FIG. 4.

What is claimed is:

1. A piston rod-less pneumatic cylinder which comprises:

a cylinder tube which has a longitudinal slot extending from an outer surface to an inner surface thereof, first and second walls of said cylinder tube providing said longitudinal slot defining longitudinally-extending sealing areas at respective inner portions thereof, a piston located in said cylinder tube and longitudinally movable therein, a transmission element located outside said cylinder tube and connected through said longitudinal slot to said piston to be longitudinally movable with said piston, a sealing tape positioned in said cylinder tube to seal said longitudinal slot longitudinally of a location of said piston, said sealing tape including a longitudinal sealing strip which is positionable against said longitudinal sealing areas of said first and second walls of said cylinder tube, said sealing tape including a longitudinal fixing strip which extends into said longitudinal slot, and an outer band located on the outer side of said cylinder tube to seal said longitudinal slot in a longitudinal direction, said outer band including first and second spaced longitudinal fixing elements which can, solely by frictional engagement with opposite first and second lateral fixing areas of said longitudinal fixing strip along portions thereof where both said longitudinal sealing strips and said outer band contact said cylinder tube, seal said longitudinal slot, said sealing tape and said outer band passing through channels in said piston.

2. The piston rod-less pneumatic cylinder according to claim 1, wherein said outer band comprises first and second spaced longitudinal band strips which respectively provide said first and second longitudinal fixing elements.

3. The piston rod-less pneumatic cylinder according to claim 1, wherein said sealing strip includes linear reinforcing elements composed of steel.

4. The piston rod-less pneumatic cylinder according to claim 1, wherein said sealing strip includes linear reinforcing elements composed of para-arimide fibers.

5. The piston rod-less pneumatic cylinder according to claim 1, wherein said first and second lateral fixing areas of said longitudinal fixing strip are provided by opposite parallel flat sides thereof.

* * * * *